US005221116A

United States Patent [19]

Lan

[11] Patent Number: 5,221,116

[45] Date of Patent: Jun. 22, 1993

[54] AUXILIARY LOCKING DEVICE FOR A DOOR KNOB

[75] Inventor: Hsin-Hsi Lan, No. 725, Sung-Shan Rd., Taipei City, Taiwan

[73] Assignees: Leading Trade Company Limited; Hsin-Hsi Lan, both of Taiwan

[21] Appl. No.: 959,157

[22] Filed: Oct. 9, 1992

[51] Int. Cl.[5] ..... E05C 17/54

[52] U.S. Cl. ..... 292/291

[58] Field of Search ..... 292/289–298, 292/258; 70/209

[56] References Cited

U.S. PATENT DOCUMENTS

| | | | |
|---|---|---|---|
| 359,815 | 3/1887 | Sargent | 292/289 X |
| 553,496 | 1/1896 | Caminetti | 292/295 |
| 928,820 | 7/1909 | Tabor | 292/296 X |
| 1,082,121 | 12/1913 | Herman | 292/294 |
| 1,888,425 | 11/1932 | Dowling | 292/291 |
| 5,131,245 | 7/1992 | Chen | 70/209 |

*Primary Examiner*—Richard E. Moore

*Attorney, Agent, or Firm*—Ladas & Parry

[57] ABSTRACT

An auxiliary locking device to be employed in a door knob includes a lock body that has at least two parallel through-bores extending through the body. A first retaining bolt is slidably received in one of the through-bores and includes two ends extending out from the lock body. A second retaining bolt is slidably received in the other one of the through bore and has an end portion extending from the lock body. The end portion of the second bolt has a plate member with an opening around the periphery of which a wall body is mounted. The wall body confines a through-hole that generally has a cross-section equal to and in communication with the opening.

4 Claims, 4 Drawing Sheets

AUXILIARY LOCKING DEVICE FOR A DOOR KNOB

BACKGROUND OF THE INVENTION

1. Field of Invention

This invention relates to an auxiliary locking device, more particularly to ones which provides additional security and which is to be employed together with a door knob so that the door is double locked and an intruder cannot enter the room even if the door is not locked by the main door knob.

2. Description of the Related Art

Sometimes, people staying in a hotel away from home feel unsafe and uneasy. The reason is simple, we all know that the hotel management possesses an extra key to the hotel room's door by which the door knob can be opened anytime. It might be purely psychological, but some people have difficulty to fall asleep with the knowledge that the room is not wholly secured from intrusion. Certainly, there is usually a chain lock provided at every room's door that includes a chain connected to a clasp and engaged by a link. Unfortunately, the chain lock can be removed once the door is unlocked and opened.

SUMMARY OF THE INVENTION

A main object of the present invention is to provide an auxiliary locking device to be employed together with a conventional door knob so as to provide a double locking security to the room and an intruder cannot easily break into the room.

Another object of the present invention is to provide an auxiliary locking device that can be taken in person along with us while on a journey and which can be easily installed in a room door's knob so as to provide an additional security to the occupant.

According to the present invention, an auxiliary locking device which is to be employed together with a conventional lock of a door includes a lock body having at least two through-bores parallel to one another extending therethrough parallel to one another. A first retaining bolt slidably received in one of the through-bores includes a first and second end extending out from the lock body. The second end of the first retaining bolt has an abutting face to abut against a door. A second bolt slidably received in the other one of the through-bores includes an end portion extending out from the lock body in the same direction as the second end of the first retaining bolt. The protruding end portion of the second bolt includes a plate member mounted thereto parallel to the axis of the second bolt. The plate member has an opening formed therein and a wall body is provided around the periphery of the opening. The wall body confines a through-hole that has a cross-section equal to and in communication with the opening. The locking device further includes a retaining means to retain the first retaining bolt and the second bolt in the through-bores of the lock body.

BRIEF DESCRIPTION OF THE DRAWINGS

Other features and advantages of the present invention will become more apparent in the following detailed description, including drawings, all of which show a non-limiting form of the invention, in which.

DETAILED DESCRIPTION OF THE PREFERRED EMBODIMENT

Figure 1:
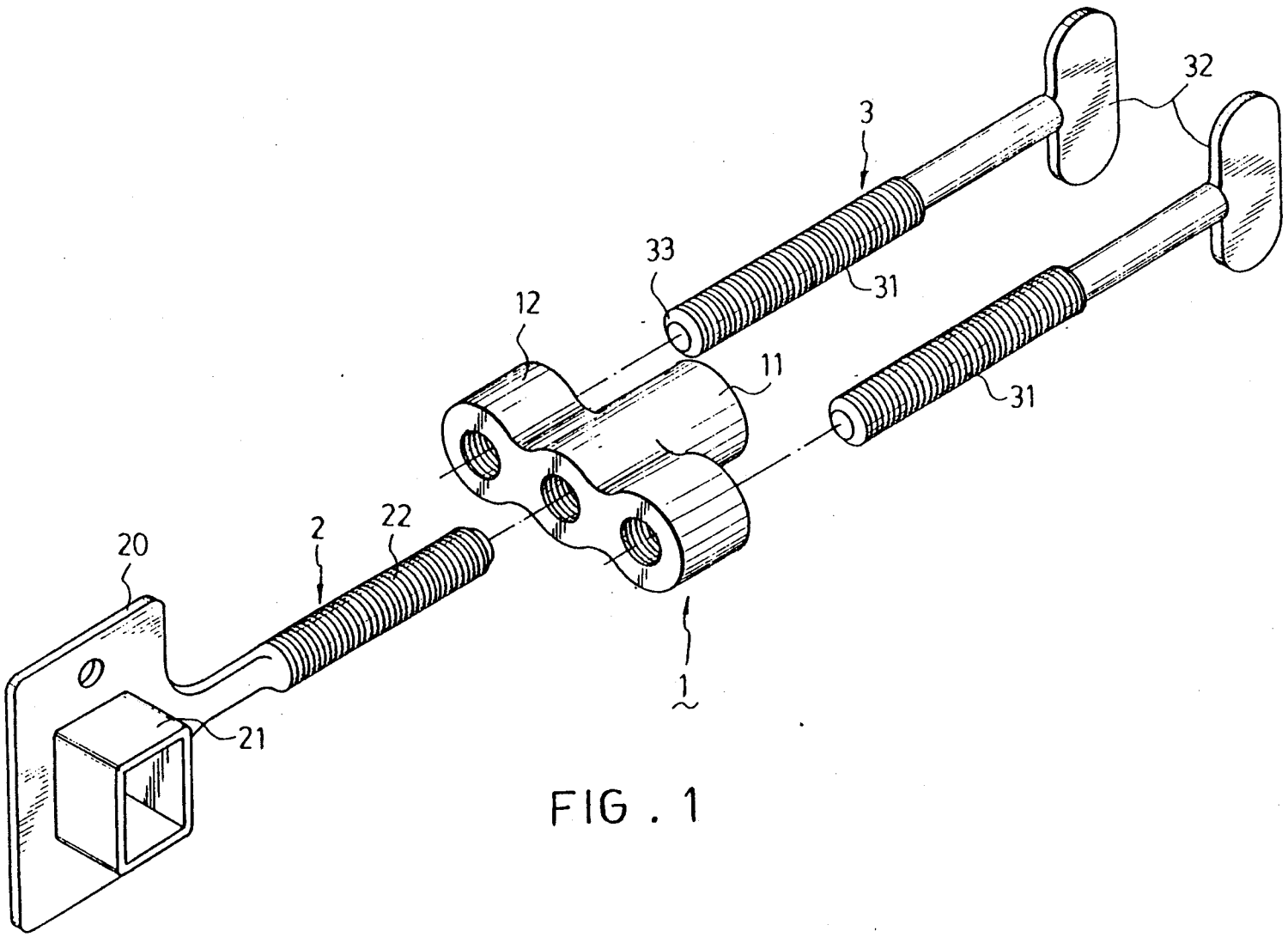
FIG. 1 is an exploded view of the auxiliary locking device of the present invention.

Referring to FIG. 1, an exploded view of an auxiliary locking device which is to be employed in a conventional door knob, is shown, said device comprising a lock body (1) having an elongated main body (11) with two symmetrical portions (12) integrally formed with the elongated main body (11) on both sides thereof, a pair of first retaining bolts (3) and a second retaining bolt (2).

The main body (11) and the two symmetrical portions (12) all has a threaded through-bores extending therethrough parallel to one another. The first pair of retaining bolts (3) have threaded sections (31) which mesh in the threaded through-bores of the symmetrical portions (12). The rear end of the first retaining bolts (3) has a turning member (32) which facilitates the rotation of the first retaining bolts (3) in the through-bores. The front end (33) of the first retaining bolts (3) is confined to be flat so that it can provide a good abutment with the door when the auxiliary locking device of the present invention is to be employed in a conventional door knob.

The second bolt (2) has a threaded section (22) which can be received in the threaded through-bore of the main body (11) and further includes a plate member (20) extending from an end of the second bolt (2) and parallel to the axis of the second bolt. The plate member (20) has an central opening around the periphery of which a wall body (21) is fixedly mounted. The wall body (21) confines a through hole which has a cross-section equal to and in communication with the opening of the plate member (20).

Figure 2:
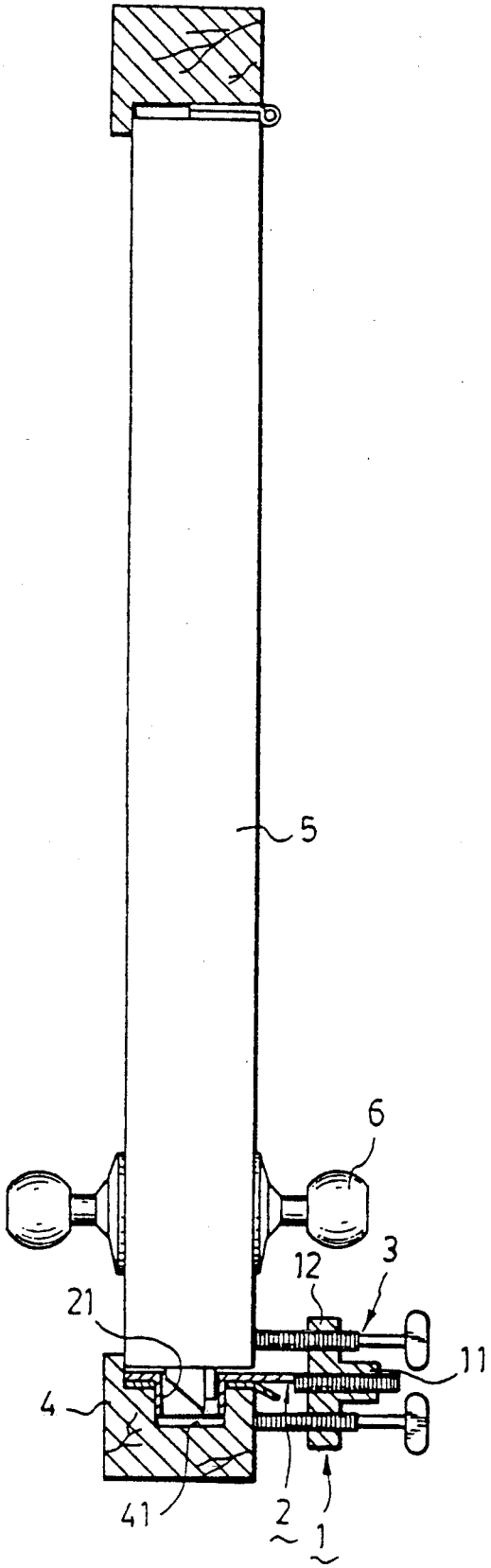
FIG. 2 shows the auxiliary locking device of the present invention, employed in conjunction with a conventional door knob of a room's door.
Figure 3:
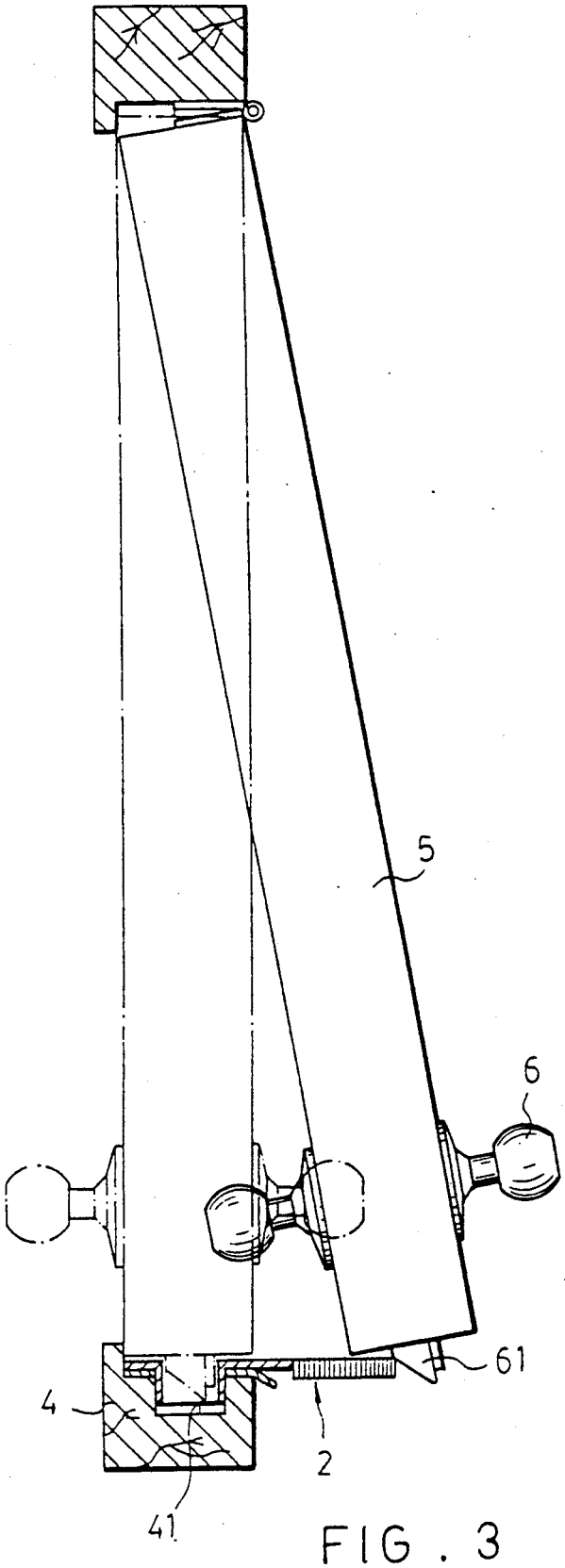
FIG. 3 shows the manner in which the auxiliary locking device of the present invention, is installed with a conventional door knob of a room's door.
Figure 4:
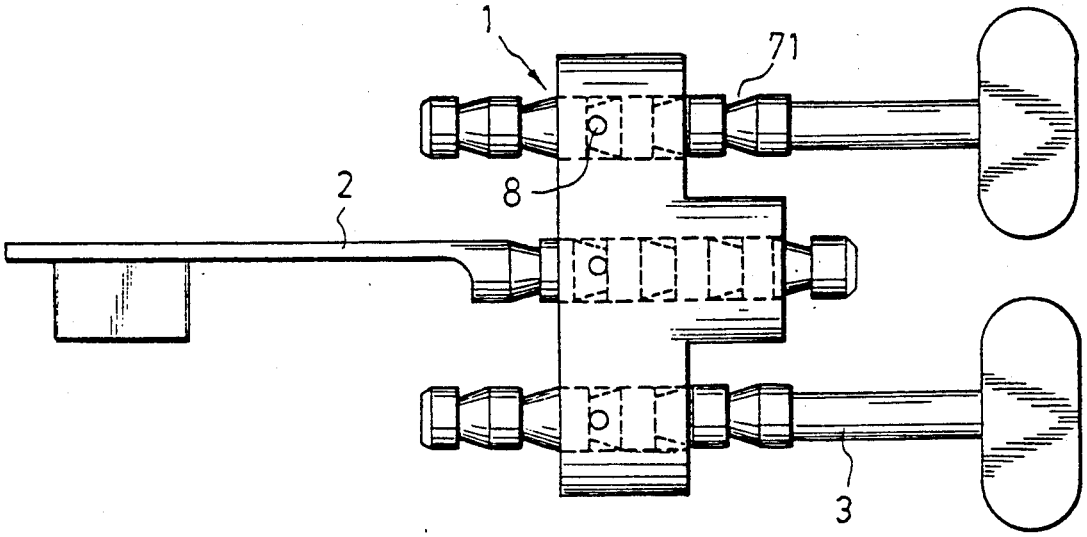
FIG. 4 shows another preferred embodiment of the auxiliary locking device of the present invention.
Figure 5:
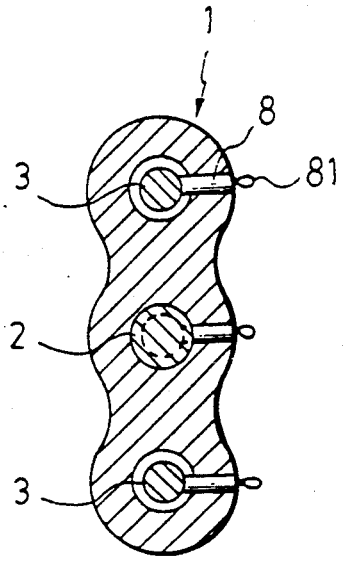
FIG. 5 shows a cross-sectional view of the preferred embodiment of the locking device of this invention shown in FIG. 4.

Referring to FIGS. 2 and 3, the locking device according to the present invention, in use, has the wall body (21) of the second bolt (2) disposed in the recessed groove (41) of a door frame (4). When the door (5) is closed, a latch bolt (61) of the door knob (6) extends into the wall body (21). The door knob (6) is generally depressed from the room so as to place the door knob (6) at a dead position. Under such condition, the door (5) cannot be opened from the outside. The threaded section (22) of the second bolt (2) is threaded to the threaded through-bore of the main body (11). The pair of first retaining bolts (3) are threadedly inserted into the through-bores of the symmetrical portions (12) and are turned until the abutting face (33) of the second end of the first retaining bolts (3) respectively abut against the door (5) and the door frame (4), as shown in FIG. 2. Since the locking device of the present invention is installed in the interior of a room, it provides additional security to the conventional door knob (6).

As shown in FIG. 3, in the event that an intruder manages to retract the latch bolt (61) interiorly of the knob (6) by any suitable method, such as by picking the lock, the door (5) would have been opened in a normal condition. However, it will not be opened because the auxiliary locking device of the present invention is provided in the room and offers additional security to the door. Thus the room provided with the locking device of the present invention is double safe.

The locking device of the present invention is easy to use and install and it can be conveniently taken along in a journey. It is important to note is that the threads formed on the first and second bolt should not generally be the same, and that the plate member (20) should be made very thin to enable the device to be employed in any every door knob.

In one preferred embodiment, the first and second bolts (2, 3) include a plurality of notches (71) formed along the length of the bolts (2, 3). The lock body (1) itself has at least three through-holes (8) respectively and transversely passing the through-bores of the lock body (1). Three pin members (81) can be inserted into the through-holes (8) which respectively extend within the notches (71) of the first and second bolts thereby retaining the first and second bolts as in the previous embodiment. The features and objects are also the same as those described in the previous embodiment.

In short the auxiliary locking device of this invention can provides the following advantages:

(1) It can be easily installed in a conventional door knob. It does not require particular skill to attach the same to the conventional door knob.

(2) Employed in association with a conventional door knob, the auxiliary locking device of the invention disables a lock-picker to enter the room even if he managed to unlock the door. The reason is that the auxiliary locking device of the present invention is installed from inside the room out of the reach of an intruder.

While the invention has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. An auxiliary locking device for a door lock which includes a latch bolt formed on a door on which said door lock is fixed and a recessed groove formed on a door frame of said door to receive said latch bolt when said door is closed , said auxiliary locking device comprising:

a lock body having at least two through-bores extending therethrough parallel to one another;

a first bolt slidably received in one of said through-bores of said lock body and having first and second ends extending out from said lock body, said second end having an abutting face formed thereat;

a second bolt slidably received in the other one of said through-bores of said lock body and having an end portion protruding out from said lock body, said end portion having a plate member mounted thereto parallel to the axis of said second bolt and further including an opening formed therein, a wall body being provided perpendicularly around the periphery of said opening and being adapted to be received in said recessed groove, said wall body confining a through-hole with a cross-section the same as that of said opening in which said latch bolt is to be received; and means for retaining said first and second bolts respectively in said through-bores of said lock body.

2. An auxiliary locking device as defined in claim 1, wherein said first end of said first locking bolt further includes a handle which facilitates turning.

3. An auxiliary locking device as defined in claim 1, wherein said retaining means includes a first screw thread formed on said first and second locking bolts and a second screw thread formed on an internal wall which confines said through bores and being adapted to match with said first screw thread.

4. An auxiliary locking device as defined in claim 1, wherein said retaining means includes at least two pin members, said lock body further having two through-holes respectively and transversely passing said through-bores, said first and second locking bolts having a plurality of notches formed along a length thereof, said pin members passing through said through-holes and extending into said notches thereby retaining said first and second locking bolts in said lock body.

* * * * *